US005325994A

United States Patent [19]

Mizialko et al.

[11] Patent Number: 5,325,994

[45] Date of Patent: Jul. 5, 1994

[54] METHOD AND APPARATUS FOR TEMPERATURE REGULATING AND DISPENSING FLOWABLE MATERIAL

[76] Inventors: Peter Mizialko, 312 Sanford Ave., Lyndhurst, N.J. 07071; Anthony Dispoto, Moon Valley Rd., Milford, Pa. 18337

[21] Appl. No.: 841,704

[22] Filed: Feb. 26, 1992

[51] Int. Cl.[5] ..... B67D 5/62

[52] U.S. Cl. ..... 222/54; 222/146.2; 222/113; 222/609; 404/111

[58] Field of Search ..... 222/54, 146.2, 609, 222/113; 404/107, 110, 111

[56] References Cited

U.S. PATENT DOCUMENTS

| | | | |
|---|---|---|---|
| 1,052,578 | 2/1913 | Fitzgerald . | |
| 1,602,887 | 10/1926 | de Florez et al. . | |
| 1,698,015 | 1/1929 | Fitzgerald . | |
| 1,750,104 | 3/1930 | Heltzel . | |
| 1,860,271 | 5/1932 | Wenning . | |
| 1,924,636 | 8/1933 | Burket . | |
| 2,308,733 | 1/1943 | White . | |
| 2,420,410 | 5/1947 | Blankner . | |
| 2,578,080 | 12/1951 | Middlestadt . | |
| 2,956,486 | 10/1960 | Siegle . | |
| 3,227,055 | 1/1966 | Glade . | |
| 3,280,710 | 10/1966 | Glade . | |
| 3,873,227 | 3/1975 | Goethe et al. . | |
| 3,946,722 | 3/1976 | Banahan . | |
| 4,307,705 | 12/1981 | Douglas . | |
| 4,416,614 | 11/1983 | Moody . | |
| 4,600,124 | 7/1986 | Price | 222/54 |
| 4,620,645 | 11/1986 | Hale . | |
| 4,630,965 | 12/1986 | Nguyen . | |
| 4,653,424 | 3/1987 | Schloss et al. . | |
| 4,732,109 | 3/1988 | Selby . | |
| 4,831,958 | 5/1989 | Selby . | |

OTHER PUBLICATIONS

*Municipal and Road Maintenance Equipement Catalog*, Aeroil Products Co., Inc., 1987, p. 13.

*Municipal and Road Maintenance Equipement Catalog*, Aeroil Products Co., Inc., 1989, p. 14.

*Primary Examiner*—Andres Kashnikow
*Assistant Examiner*—Kenneth Bomberg
*Attorney, Agent, or Firm*—Curtis, Morris & Safford

[57] ABSTRACT

The present invention is an apparatus for dispensing flowable material which comprises a holding vessel for holding a supply of flowable material, a dispensing device for releasing an amount of flowable material from the holding vessel, a first heating element for heating the flowable material in the holding vessel, a second heating element, in operative association with the first heating element for heating the dispensing device such that the latter can be activated by the former, a unified control system for sensing the condition of the second heating element and of the flowable material in the holding vessel, and coordinating the operation of the first and second heating elements such that the second heating element intermittently activates the first heating element in response to a preselected sensed condition of the flowable composition, and such that the first and second heating element are disabled in response to a preselected sensed condition of the second heating element.

35 Claims, 5 Drawing Sheets

METHOD AND APPARATUS FOR TEMPERATURE REGULATING AND DISPENSING FLOWABLE MATERIAL

FIELD OF THE INVENTION

The present invention relates generally to methods and devices for surface repair and construction and more particularly to methods and devices for dispensing flowable materials into cracks and joints.

BACKGROUND OF THE INVENTION

Surfaces which have been paved with asphalt, concrete or other material typically develop cracks. These cracks can be due to the expansion and contraction of joints, the freezing and thawing of water that has worked its way into the pavement, the movement of the ground underneath or simply excessive impact. Such cracks cause problems because they degrade the pavement resulting in an uneven surface and loose debris.

Various methods have been employed to remedy the problems caused by such cracks. Repaving the surface is one option, but this is not always practical. A preferred method, is to seal the cracks by filling them with a flowable material which hardens over time while retaining a degree of flexibility.

Moreover, when sidewalks, runways and other roadways are initially fabricated, they are typically laid out in sections with expansion joints between adjacent sections to accommodate expansion and contraction due to atmospheric changes. Frequently, such expansion joints are comprised of the same material used to seal cracks.

A common technique for filling expansion joints or cracks is dispensing flowable material from a pouring pot (a device resembling a watering can) by manually tilting the pot. This technique has a number of significant disadvantages. First, the flowable material is usually heated in excess of 200° F. to allow it to achieve a liquid state, thus, the person using the pouring pot must protect against burns. Second, since the pot has no heat source, the material must be poured quickly or it will solidify. This is especially true in colder weather. User fatigue and human inaccuracy are also factors which contribute to poor end results and are a direct result of using the pouring pot technique. (As regards inaccuracy, it is important to note that accurate placement of the sealant material in the crack or expansion joint is critical on an airport runway. This is because as airplanes take-off and land, the wheels get so hot, they can pull the sealant material right off the runway. If this happens, pieces of the material can be drawn into a jet engine and disable it. Thus, there are rigid FAA specifications which must be adhered to in the application of the sealant on airport runways.)

One attempt to overcome the disadvantages associated with the pouring pot technique, is an apparatus which includes a long wand, connected by a feeder hose to a large, mobile heated kettle (see U.S. Pat. No. 4,620,645). However, this approach also has several drawbacks. First, the wand is attached to the large kettle (usually part of or pulled by a truck) which limits the operator's range of movement to an area determined by the length of the feeder hose. Thus, at least two people must be on a single site to keep the project from being continuously interrupted. Additionally, the wand itself is very heavy and hot and is carried by the user. Fatigue therefore becomes a significant factor.

A number of other devices have been developed. These devices are essentially mobile hand carts, many of which include heated holding vessels, pour spouts and fuel storage tanks. ( See e.g. U.S. Pat. Nos. 2,578,080, 3,227,055, 3,280,710, 3,873,227, 4,732,109, 4,831,958 and Aeroil Municipal and Road Maintenance Equipment Catalog No. 1-89, page 14.) These devices, while providing some improvement suffer from still other problems. First, all include burner elements, and the manual ignition of fuel at the burners entails the risk of injury from explosion. For instance, Aeroil's suggested ignition procedure is to light a piece of paper, start the fuel flowing to the burner and then to roll the cart over the lit paper. Still further, if the wind blows out the flame or the flow of fuel is momentarily interrupted thereby extinguishing the flame, there is nothing to prevent the build-up of unconsumed fuel near the burners. This clearly imposes the risk of injury. The inability to adequately clean these devices is another serious drawback. For instance, the round shape of the Aeroil holding vessel severely limits the ability to scrape out debris and solidified material. Still further, the parts of most of the aforementioned devices are permanently welded or fastened together such that the pour spouts and other components cannot be repaired or replaced as necessary.

The provision of a method and apparatus which affords a way of effectively, safely and conveniently dispensing a flowable material suitable for the filling and sealing of cracks or joints, as aforementioned, would be a substantial advance.

OBJECTS OF THE INVENTION

It is an object of the present invention to provide a new method and apparatus for dispensing flowable material.

It is another object of the present invention to provide a method and apparatus for dispensing flowable material which is designed for automatic regulation of the temperature of the flowable material.

It is yet another object of the present invention to provide a method and apparatus for dispensing flowable material which is designed for safe operation in the application of heat to the flowable material.

It is a further object of the present invention to provide a method and apparatus for dispensing flowable material which can be easily cleaned and repaired.

SUMMARY OF THE INVENTION

In one aspect, the invention is an apparatus for dispensing a flowable material which comprises holding means for holding a supply of flowable material; dispensing means for releasing an amount of flowable material from said holding means; first heating means for heating said flowable material in said holding means; second heating means for heating said dispensing means, said second heating means being in operative association with said first heating means such that the latter can be activated by the former; and unified control means for sensing the condition of the second heating means and of said flowable composition in the holding means, and coordinating the operation of the first and second heating means such that the second heating means intermittently activates the first heating means in response to a preselected sensed condition of the flowable composition, and such that the first and second heating means are disabled in response to a preselected sensed condition of the second heating means.

In another aspect, the invention is a method of dispensing a flowable material which comprises providing a reservoir of material which can be rendered flowable, sensing a preselected condition of said material and in response to a preselected sensed condition of the material intermittently applying heat from a first heat source to said material to maintain it in a flowable state, providing a path for delivery of the material from the reservoir to the point of dispensation, applying heat from a second heat source along at least a part of said path to prevent congealing of flowable material, activating said first heat source with said second heat source to effect said intermittent application of heat, sensing the condition of said second heat source and providing means for the disabling of both heat sources in response to a preselected sensed condition of the second heat source.

The advantages conferred by practice of the present invention are significant. The invention is simple and safe in operation. With it, the temperature of the flowable material is automatically regulated. Additionally, cleaning and repair are easy. And, an operator, working alone, can accurately seal cracks and joints at a rate ten (10) times that of the pouring pot and wand techniques, without fatigue.

The foregoing, and other objects, aspects and advantages of the invention will be elucidated in the following more detailed discussion.

DESCRIPTION OF THE DRAWINGS

In the drawings:

FIG. 3 is a cross sectional view of the inside of the vessel of a preferred embodiment of the present invention the inside of the vessel of.

DETAILED DESCRIPTION OF CERTAIN PREFERRED EMBODIMENTS

A central feature of several embodiments of the present invention is a unified control system for the heating means. Preferably, this system comprises a burner control unit, which is in essence a fuel flow control device, for directing the operation of two burner elements. The first element heats the holding means typically a metal vessel, to bring the sealing material within a preselected temperature range and return it to within such range should it fall below the lower limit. The second burner element heats the pour spout of the device such that sealant material therein, which could otherwise congeal, is maintained in a flowable state. The second burner element also acts as a pilot and is capable of igniting the first burner element. The control system coordinates the operation of the burner elements to achieve the desired result.

Each burner element is associated with a thermocouple. The thermocouples communicate with the burner control unit to provide information in response to which valves (within the burner control unit) for controlling the flow of fuel to the burners are opened and closed.

The thermocouple associated with the first burner element is typically located inside the holding vessel, and acts to maintain the flow of fuel to the first burner element when the temperature of the flowable material is below a preselected point. The second thermocouple, which is associated with the second burner element, acts to maintain the flow of fuel to the second burner element while the burner element is ignited. This second burner element functions as a pilot light and is in operative association with the first burner element, i.e. is located sufficiently proximate the first burner element, that this latter element can be ignited by the second burner element. If the second burner element is extinguished, the second thermocouple senses a temperature drop and the flow of fuel is cut off, thereby disabling the first and second burner elements.

In a preferred embodiment of the present invention the apparatus is of modular construction which permits most of the components to be easily removed and/or disassembled for maintenance or replacement. Such elements include the agitator, the pour spout and valve, the wheels, the fuel storage tank, the ignitor assembly, the burner control unit and the burner elements.

Figure 1:
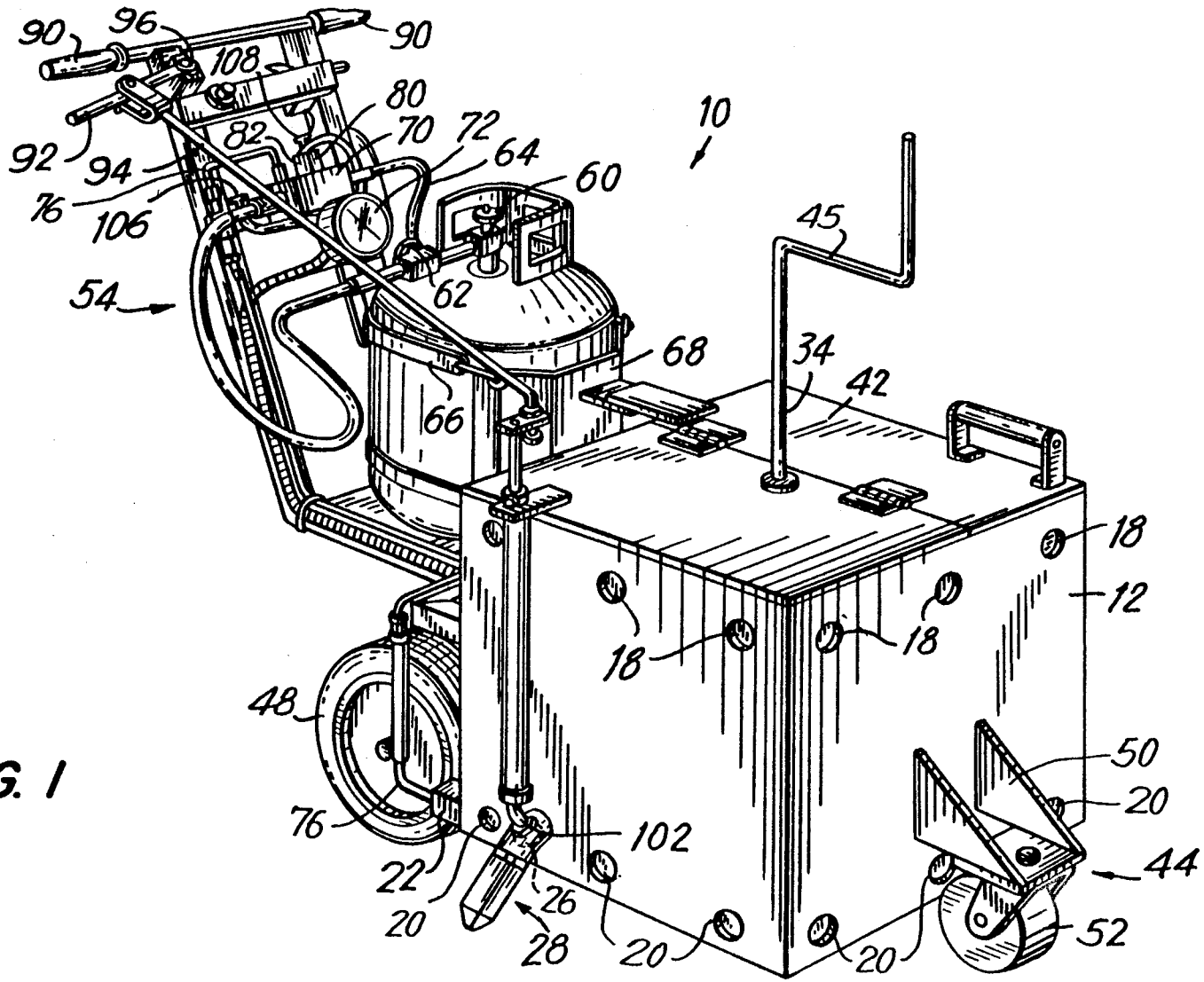
FIG. 1 is a perspective view of a preferred embodiment of the present invention.
Figure 2:
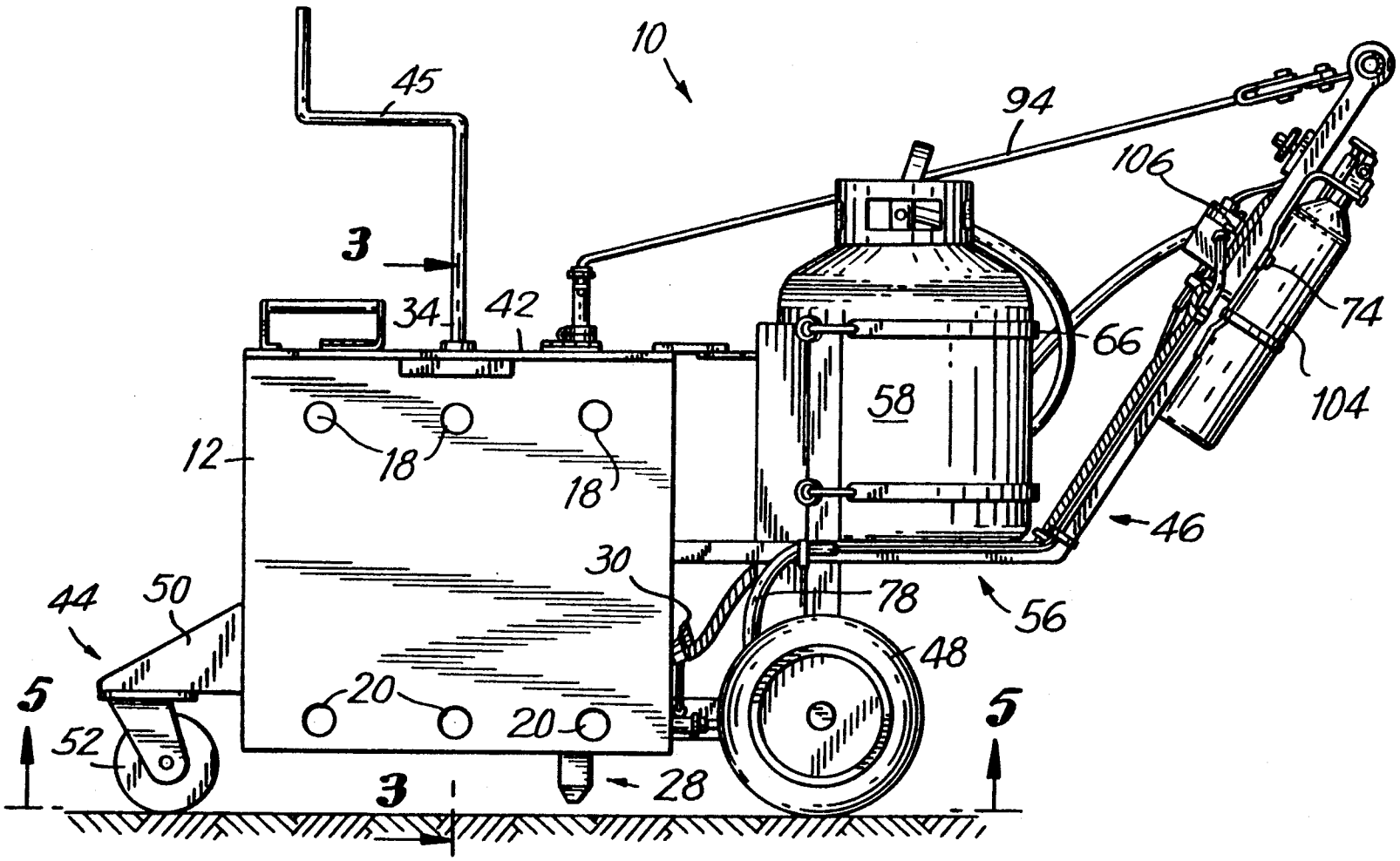
FIG. 2 is a left side view of a preferred embodiment of the present invention.

Referring initially to FIG. 1, an apparatus, constructed in accordance with the present invention, is designated generally by the numeral 10. The apparatus 10 includes a holding vessel 12 in which the material to be dispensed is maintained. Vessel 12 includes two walls 14 and 16. The inner wall 14 actually contains the flowable material. The outer wall 16 extends below the inner wall 14 and is spaced apart from it to provide an area in which heated air can reside. The upper portion of outer wall 16 has, on three sides, a plurality of vents 18. These vents 18, in conjunction with the space defined between the inner wall 14 and the outer wall 16, create a chimney effect to draw heated air up along the inner wall 14. The bottom of outer wall 16 has a plurality of similar vents 20 to allow air to flow underneath the vessel 12 to burner elements 22 and 24.

A valve assembly 26, preferably a ball valve with Teflon seals, communicates with the interior of vessel 12 and a removable pour spout 28. The valve assembly 26 is operated remotely to permit the flowable material to flow from the vessel 12, through the pour spout 28, into a crack or the like.

The pour spout 28 is removably attached to the valve assembly 26. It preferably extends at an angle of approximately 45° from the vessel 12. The opening 100 of the pour spout 28 is preferably of trapezoidal shape to optimize the flow of sealant into the crack or joint. Because the pour spout 28 is removable, varying lengths and opening sizes can be employed depending on the size and configuration of the crack or joint to be sealed.

A thermometer 30, preferably of the type having a single needle on a round face,. also communicates with the interior of the vessel 12. The thermometer 30 permits the operator to make an easy check of the temperature of the flowable material to verify its being within a desired range.

A strainer 32 is attached to the inner walls 14 of the vessel to trap lumps of solidified sealant material or debris. The strainer 32 has utility only when preheated or normally liquid sealant materials are employed.

Figure 4:
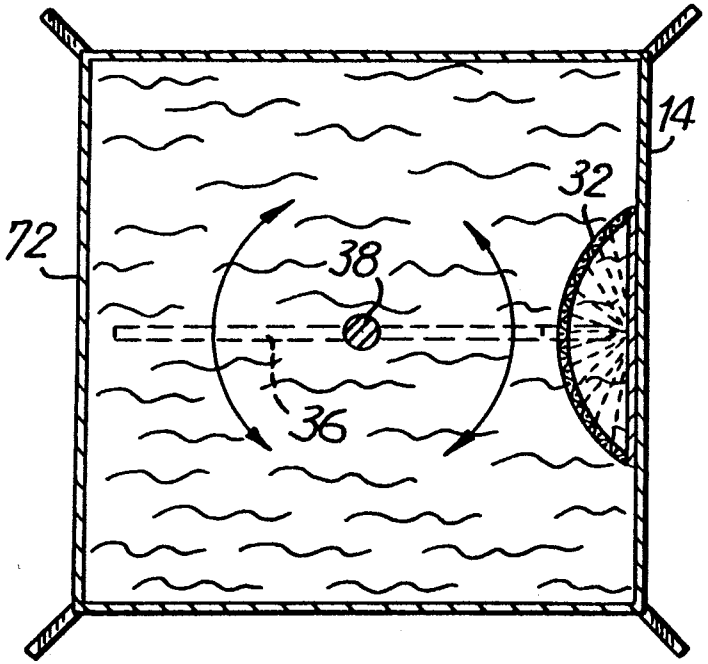
FIG. 4 is a top cross-sectional view of taken along line 3—3 of FIG. 2 a preferred embodiment of of the present invention taken along line 4—4 of FIG. 3.
Figure 3:
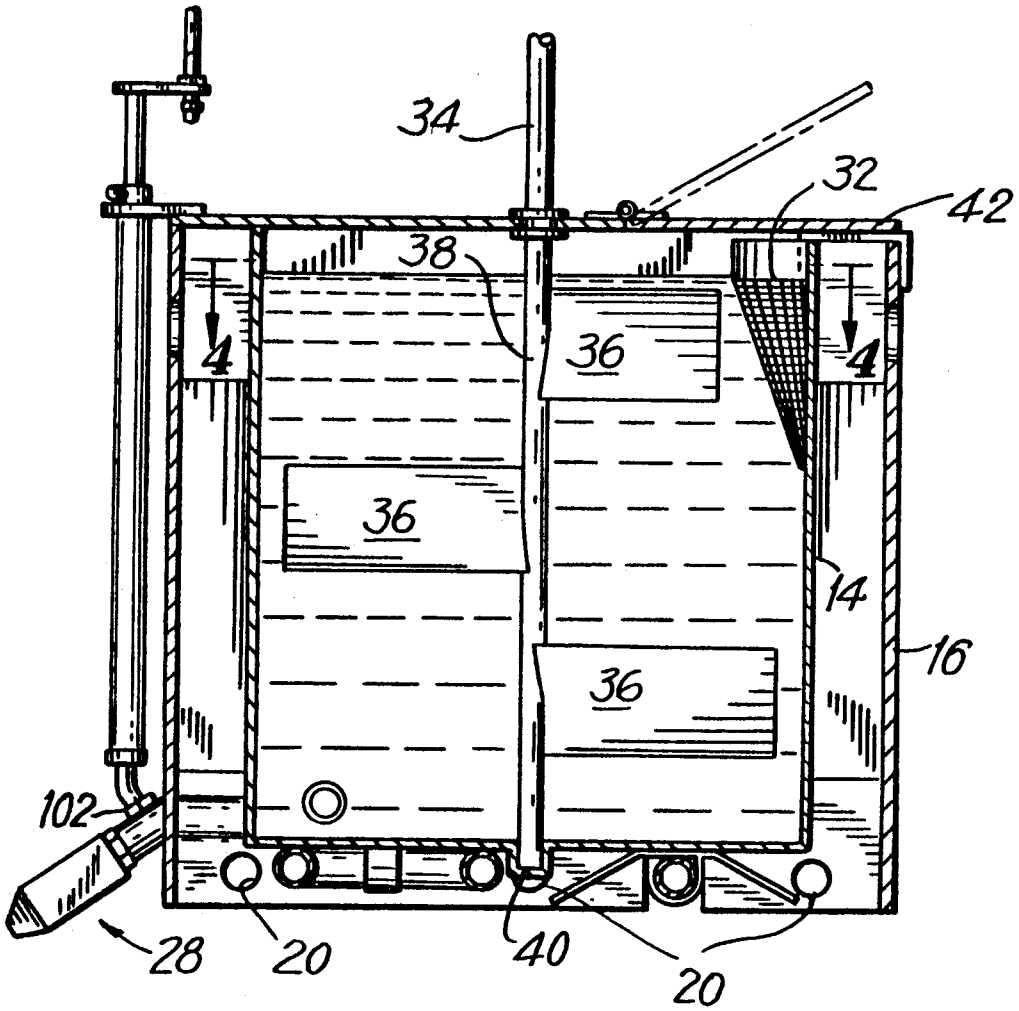
Figure 5:
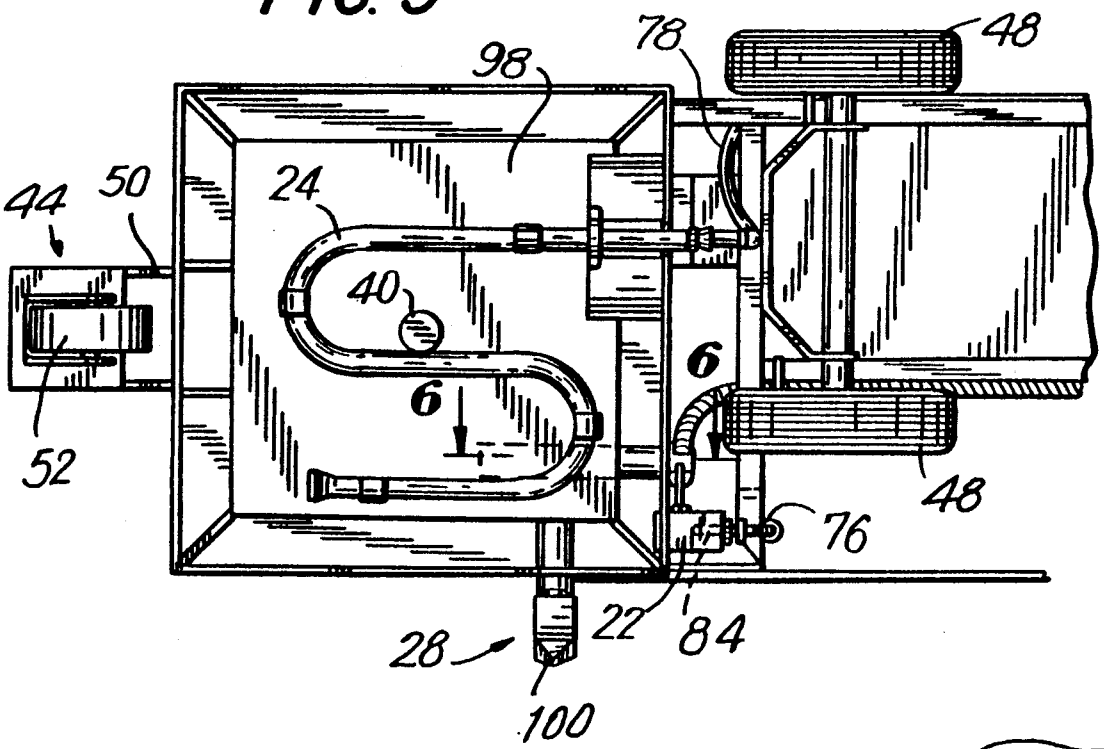
FIG. 5 is a partial bottom view of a preferred embodiment of the present invention taken along line 5—5 of FIG. 2.
Figure 6:
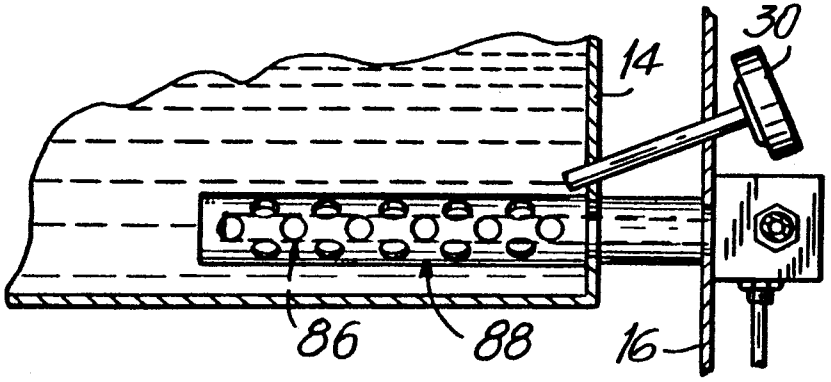
FIG. 6 is a partial cross-sectional view of the thermocouple and thermometer inside the vessel of the present invention taken along line 6—6 of FIG. 5.
Figure 7:
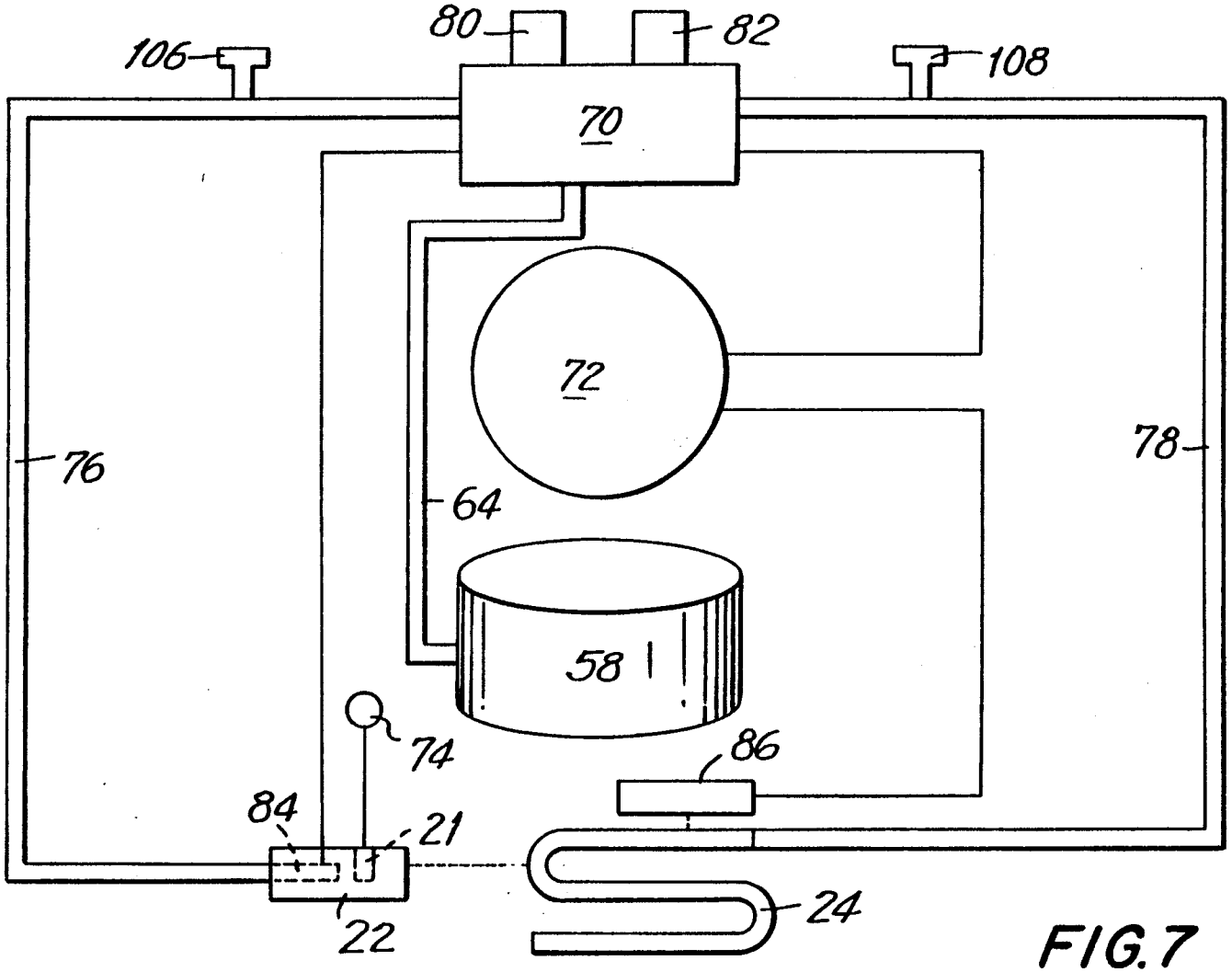
FIG. 7 is a schematic drawing of the interrelationships between the elements of the heat control system of the present invention.

An agitator 34, preferably having a plurality of blades 36 mounted on central shaft 38, is located within the vessel 12. The agitator 34 is employed to improve the temperature uniformity of the material in the vessel 12. The bottom of the shaft 38 rests in a plug 40 (see FIGS. 3–5) which acts as a seat for the agitator 34. (The plug 40 can also be used to drain the vessel 12 of liquid sealant, or solvents or the like used in cleaning.) The top portion of the central shaft 38 extends through a hinged lid 42 (See FIG. 1) and preferably terminates in a handle portion 45.

In the preferred embodiment shown in FIG. 1, the agitator 34 is manually actuated. However, in another preferred embodiment of the present invention (not shown) the agitator 34 is driven by a small motor mounted on a fixed portion of the lid 42.

The lid 42 provides access to the interior of the vessel 12. The lid 42 also serves to maintain the heat in the vessel 12 and, if necessary, allows extra ventilation when the material in the vessel 12 gets too hot. Still further, in the event the flowable material catches fire, closing the lid 42 will deprive the fire of oxygen and will eventually put the fire out. (A fire extinguisher 104 is preferably associated with the apparatus 10 in case of fire.)

The vessel 12 is supported by a front wheel unit 44, and a cart unit 46 mounted on two removable wheels 48. The front wheel unit 44 comprises a wheel support piece 50 affixed to the outer wall 16 of the vessel 12 and a removable front wheel 52.

The cart unit 44, which is also affixed to the vessel 12, is comprised of two main portions, a handle portion 54 and a storage tank support portion 56. A storage tank 58 is mounted on the storage tank support portion 56. The tank 58 is preferably used to store pressurized propane gas. A main hand valve 60 is used to control the flow of gas out the tank 58. A standard pressure regulator 62 is affixed to an outflow line 64 to regulate the pressure of the gas flowing from the tank 58. A flexible cord 66 is fitted around the tank 58 and affixed on each end to a guard wall 68. The flexible cord 66 permits the apparatus 10 to be tilted for cleaning or inspection without substantial movement of the tank 58. The guard wall 68 provides a separation between the heated vessel 12 and the fuel-filled tank 58.

The handle portion 54 is at an oblique angle to the storage tank support portion 56. Handles 90 extend on either side of the top of the handle portion 54. The handles are used to push and control the apparatus 10. Extending outwardly from one of the handles 90 is a valve control lever 92, which through a valve control rod 94, controls the operation of valve assembly 26 and consequently the flow of material through pour spout 28. The lever 92 pivots about a point 96 and is infinitely variable. A spring bias is preferably omitted to avoid operator fatigue. However, for certain applications a bias default to the closed position of the valve assembly 26 can be advantageous.

Mounted on the handle portion 54 are a burner control unit 70, a thermostat 72 and a rotary ignition switch 74. The burner control unit 70 controls the flow of fuel to the burner elements 22 and 24. One such device is the Model 7000 BMU—250 to 750 Millivolt Combination Gas Valve made by Robert Shaw.

The outflow line 64 from the fuel tank 58 is connected to the burner control unit 70. Two outflow lines 76 and 78, each connected at one end to the burner control unit 70, are connected at the other ends with the two burner elements 22 and 24, respectively. These lines 76 and 78 carry fuel, when it is flowing, from the burner control unit to the burner elements 22 and 24. Each line 76 and 78 is separately controlled by a throttle 106 or 108. The throttles 106 and 108 control the quantity of fuel flowing from the burner control unit 70 to the burner elements 22 and 24. These can be adjusted to obtain the desired thermal output (BTU's). from the burner elements 22 and 24 in order to optimize results in various ambient air temperatures. This is entirely independent of any thermostatic control.

The burner control unit 70 has a plurality of valves 80 and 82 which directly control the flow of fuel from the burner control unit 70 to the burner elements 22 and 24. The first valve 80 may be manually opened by downward pressure or may be sustained in an open position by a small current flow. Such a current flow can originate from a thermocouple 84 associated with the burner 22 (See FIG. 5). When the burner 22 is lit, the heat generated by the flame causes the thermocouple 84 to generate current. This current is sufficient to keep electromagnetic valve 80 open and the fuel flowing, without manual intervention. Similarly, thermocouple 86, which is located inside the vessel 12 and is protected by a guard 88, provides current to the thermostat 72, which, in turn, controls the operation of valve 82. The thermostat 72 provides the necessary feedback to control valve 82 to maintain the flow of fuel to burner element 24, thus controlling the temperature of flowable material within a preselected range.

The main burner element 24 is preferably configured in serpentine pattern (see FIG. 5) to provide more even distribution of heat. This burner element 24 is ignited by burner element 22 which acts as a pilot for burner element 24 as well as a heater for the pour spout 28 (to prevent material from cooling and clogging the pour spout). Burner element 22, in turn, is lit by a spark generated by a rotary electronic ignition assembly, the switch 74 of which is located on the handle portion 54.

In use, the lid 42 of the apparatus 10 is opened and a quantity of sealant material is put in the vessel 12. The sealant material can be preheated in large kettle (not shown) and poured into the vessel 12 through strainer 32, or solidified chunks can be dropped in.

The main burner element 24 must then be lit to begin heating or maintaining the material within a preselected temperature range. This is done by first lighting the pilot burner 22. The valve 80, on the burner control unit 70, is manually depressed to allow fuel to flow to the burner element 22. At the same time the rotary ignition switch 74 is rotated to cause the ignitor 21 to create a spark which ignites the fuel flowing to burner element. After a short time, the heat generated by the flame at the burner element 22 will be sufficient to cause the thermocouple 84 to generate enough current to hold the valve 80 open without manual intervention.

A gas cock (not shown) on the burner control unit is rotated and the thermostat 72 is then set to a selected temperature to open valve 82. This allows fuel to flow to the main burner element 24. The pilot 22 will ignite the fuel flowing to the main burner element 24 as the fuel achieves appropriate distribution. The flame is protected from wind by the lower extension of outer wall 16, yet provided with sufficient oxygen through vents 20.

The heat generated by the main burner element 24 directly heats the bottom 98 of the vessel 12. It also indirectly heats the sides of the vessel 12 by the upward movement of heated air between the inner and outer walls 14 and 16 which flows out through vents 18. (Their are no vents on the back wall 16 of the vessel 12 to minimize the heat in the vicinity of the fuel tank 58).

The contents of the vessel 12 are preferably agitated frequently with agitator 34 to distribute the heat evenly and to prevent the bottom portion from burning.

When the sealant in the vessel 12 reaches a temperature within the preselected range, the main burner will shut off. This is because the thermocouple 86 provides input to the thermostat 72 which, in turn, signals valve 82 to close. When the temperature falls below the preselected range the thermostat 72 will respond to the signal from the thermocouple 86 and will cause valve 82 to reopen and resume the flow of fuel to the main burner 24. Since the pilot 22 is still lit (absent unusual circumstances such as severe wind, in which case valve 82 will not open anyway) the main burner 24 will simply relight automatically. This process continues as long as there is fuel in the tank 58 and the thermostat 72 is set above 0.

As soon as the material in the vessel 12 reaches appropriate operating temperature, as indicated by the thermometer 30, the apparatus 10 can be used to fill cracks or joints. The operator simply places the end 100 of the spout 28 over the crack and pulls the valve control lever 92. This opens valve assembly 26 and sealant flows through pour spout 28, heated by burner element 22, into the crack. The operator pushes the apparatus 10 forward, using handles 90, and the crack is filled to a level based on the speed of locomotion. (To keep the device from contacting the liquid sealant material which has just been dispensed, the entire tank support portion 56 and handle portion 54, and consequently the wheels 48, are preferably offset away from the pour spout 28. In this situation, the front wheel is moved proportionally to compensate for this offset.) When the end of crack is reached or the operator wishes to stop, the valve control lever 92 is returned to its original position and valve control rod 94 shuts valve assembly 26 through a universal assembly 102.

If wind blows out the main burner 24, it will be re-lit by pilot 22. If wind blows out both burners 22 and 24 the lack of heat to the thermocouple 84 will shut valve 80, thereby shutting off the flow of fuel to both burner elements 22 and 24. This is a significant safety feature.

If a fire breaks out, a fire extinguisher 104 which is preferably mounted on the handle portion 54 can be used as a last resort.

The construction of the apparatus 10 is modular to permit easy cleaning and repair. As noted, previously the wheels 48 and 52, the pour spout 28, the tank 58, the agitator 34, the burner control unit 70, the thermostat 72, the burner elements 22 and 24 and the ignitor assembly are all removable. This permits flexibility for different uses and prolongs the life of the apparatus 10.

While reference has been made to particular components and configurations one of skill in the art could make modifications and additions without departing from the spirit and intent of the invention.

We claim:

1. Apparatus for dispensing flowable material comprising:

holding means for holding a supply of flowable material; dispensing means for releasing an amount of flowable material from said holding means;

first heating means for heating said flowable material in said hold means;

second heating means for heating said dispensing means, said second heating means being in operative association with the first heating means such that the first heating means can be activated by the second heating means;

unified control means for: (a) sensing the condition of the second heating means; and (b) sensing the condition of said flowable material in the holding means, wherein said unified control means coordinates the operation of the first and second heating means; such that the second heating means intermittently activates the first heating means in response to a preselected sensed condition of the flowable material of said holding means; and such that the first and second heating means are disabled in response to the sensing of a temperature at or below a preselected temperature of the second heating means.

2. Apparatus for dispensing flowable material comprising:

holding means for holding a supply of flowable material; dispensing means for releasing variable amounts of the flowable material from said holding means;

first burner means for heating said flowable material in said holding means;

second burner means for heating said dispensing means, said second burner means being in operative association with said first burner means such that the latter can be activated by the second burner means;

unified control means for: (a) sensing the temperature of the flowable material in the holding means; and (b) regulating a supply of fuel to the first burner means such that i) in response to the sensing of a temperature below a preselected minimum, fuel is supplied to said first burner element such that the fuel can be ignited by flame emitted by the second burner element, and ii) in response to the sensing of a temperature at or above a preselected maximum, the supply of fuel to said first burner means is interrupted and the flame is extinguished.

3. Apparatus as defined in claim 2, wherein said control means includes first thermocouple means for sensing the temperature of the flowable material in the holding means and second thermocouple means for sensing the temperature in the vicinity of the second burner element.

4. Apparatus according to claim 3, wherein said control means includes a plurality of valves, wherein at least one of said valves is actuated in response to current generated by said first thermocouple means.

5. Apparatus according to claim 4, wherein at least two of said plurality of valves are electromagnetic valves.

6. Apparatus according to claim 5, wherein at least one of said electromagnetic valves is maintained in an open position by current generated by said first thermocouple in response to the presence of heat at said second burner means.

7. Apparatus according to claim 2, further comprising electronic ignition means for igniting fuel flowing to said second burner means, wherein said electronic ignition means comprises an ignitor located adjacent to said second burner means.

8. Apparatus according to claim 7, wherein said electronic ignition further comprises a rotary ignition switch.

9. Apparatus according to claim 2, wherein said dispensing means comprises a removable spout mounted at approximately 45° to the bottom of said holding means.

10. Apparatus according to claim 9, wherein said dispensing means further comprises means capable of remotely varying the flow of said flowable material through said spout.

11. Apparatus according to claim 10, wherein said variable dispensing means further comprises a ball cock valve.

12. Apparatus according to claim 11, wherein the lower end of said spout is shaped in the form of a trapezoid.

13. Apparatus according to claim 2, wherein said first burner means comprises a serpentine element located below said holding means.

14. Apparatus according to claim 2, wherein said holding means is surrounded by a second wall on four sides spaced apart from said holding means.

15. Apparatus according to claim 14, wherein at least three of said four walls has a plurality of apertures in its upper portions.

16. Apparatus according to claim 15, wherein said holding means is covered by a lid providing selective access to the interior of said holding means.

17. Apparatus according to claim 16, further comprising agitation means for agitating the flowable material in said holding means to achieve even heating of the flowable material.

18. Apparatus according to claim 17, wherein said holding means includes a removable plug on its bottom portion, wherein said plug provides a bottom support for said agitation means.

19. Apparatus according to claim 18, wherein at least a portion of said agitation means protrudes through said lid thereby providing the ability to agitate the flowable material in said holding means manually.

20. Apparatus according to claim 19, wherein a strainer is mounted on an interior wall of said, holding means.

21. Apparatus according to claim 20, wherein said holding means is rectangular in shape.

22. Apparatus according to claim 3, wherein said first thermocouple is protected by guard means attached to the inside of said holding means.

23. Apparatus according to claim 2, wherein said fuel supply to said first and second burner means is from fuel storage means selectively mounted on movable support means by a flexible cord.

24. Apparatus according to claim 2, wherein said holding means is mounted on movable support means including at least three removable wheels.

25. Apparatus according to claim 24, wherein said movable support means includes two rear wheels and a front wheel.

26. Apparatus according to claim 25, wherein said front wheel is mounted slightly off-center to offset the fuel storage means which is also mounted on said movable support means correspondingly off-center.

27. Apparatus according to claim 24, wherein said movable support means has a fire extinguisher mounted thereon.

28. An apparatus according to claim 2, wherein said dispensing means comprises: a pour spout, a valve connected to said pour spout; and lever means for controlling said valve to regulate a flow of material through said pour spout.

29. An apparatus according to claim 2, wherein said first heating means comprises a burner element operatively associated with a thermocouple.

30. An apparatus according to claim 2, wherein said second heating means comprises a burner element operatively associated with a thermocouple.

31. An apparatus according to claim 1, wherein said holding means comprises a double-walled holding vessel.

32. An apparatus according to claim 1, wherein said dispensing means comprises: a pour spout; a valve connected to said pour spout; and lever means for controlling said valve to regulate a flow of material through said pour spout.

33. An apparatus according to claim 1, wherein said first heating means comprises a burner element operatively associated with a thermocouple.

34. An apparatus according to claim 1, wherein said second heating means comprises a burner element operatively associated with a thermocouple.

35. An apparatus according to claim 2, wherein said holding means comprises a double-walled holding vessel.

* * * * *